US006563472B2

(12) United States Patent
Durham et al.

(10) Patent No.: US 6,563,472 B2
(45) Date of Patent: May 13, 2003

(54) REFLECTOR ANTENNA HAVING VARYING REFLECTIVITY SURFACE THAT PROVIDES SELECTIVE SIDELOBE REDUCTION

(75) Inventors: Timothy Durham, Palm Bay, FL (US); Yves Patenaude, Kirkland (CA); Jay Kralovec, Melbourne, FL (US); Verlin Hibner, Melbourne Beach, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 09/825,134

(22) Filed: Apr. 2, 2001

(65) Prior Publication Data

US 2002/0018023 A1 Feb. 14, 2002

Related U.S. Application Data

(63) Continuation-in-part of application No. 09/666,008, filed on Sep. 19, 2000, now Pat. No. 6,421,022, which is a continuation of application No. 09/392,134, filed on Sep. 8, 1999, now Pat. No. 6,140,978.

(51) Int. Cl.[7] ..... H01Q 15/02; H01Q 19/00

(52) U.S. Cl. ..... 343/781 P; 343/756; 343/909

(58) Field of Search ..... 343/756, 781 CA, 343/781 R, 781 P, 840, 912, 909, 915; 333/134, 202

(56) References Cited

U.S. PATENT DOCUMENTS

| | | | | |
|---|---|---|---|---|
| 4,017,865 A | | 4/1977 | Woodward | 343/781 |
| 4,125,841 A | | 11/1978 | Munk | 343/909 |
| 4,525,719 A | | 6/1985 | Sato et al. | 343/761 |
| 5,041,840 A | | 8/1991 | Cipolla et al. | 343/725 |
| 5,103,241 A | * | 4/1992 | Wu | 343/872 |
| 5,160,936 A | | 11/1992 | Braun et al. | 343/725 |
| 5,162,809 A | | 11/1992 | Wu | 343/909 |
| 5,208,603 A | | 5/1993 | Yee | 343/909 |
| 5,327,149 A | | 7/1994 | Kuffer | 343/720 |
| 5,400,043 A | * | 3/1995 | Arceneaux et al. | 343/872 |
| 5,451,969 A | | 9/1995 | Toth et al. | 343/781 |
| 5,485,167 A | | 1/1996 | Wong et al. | 343/756 |
| 5,485,168 A | | 1/1996 | Parekh | 343/761 |
| 5,496,966 A | * | 3/1996 | Hightower et al. | 174/35 MS |
| 5,497,169 A | | 3/1996 | Wu | 343/909 |
| 5,581,265 A | | 12/1996 | Stirland et al. | 343/756 |
| 5,592,186 A | * | 1/1997 | Hoofe et al. | 343/705 |
| 5,652,631 A | | 7/1997 | Mullen et al. | 343/872 |
| 5,673,056 A | | 9/1997 | Ramanujam et al. | 343/756 |
| 5,892,485 A | | 4/1999 | Glabe et al. | 343/789 |
| 5,917,458 A | * | 6/1999 | Ho et al. | 343/769 |
| 5,949,387 A | | 9/1999 | Wu et al. | 343/909 |
| 6,031,506 A | | 2/2000 | Cooley et al. | 343/840 |
| 6,140,978 A | | 10/2000 | Patenaude et al. | 343/909 |
| 6,208,316 B1 | * | 3/2001 | Cahill | 343/909 |
| 6,421,022 B1 | * | 7/2002 | Patenaude et al. | 343/781 P |

OTHER PUBLICATIONS

David C. Jenn, and Willard V.T. Rusch, "Low–Sidelobe Reflector Synthesis and Design Using Resistive Surfaces" *IEEE Transactions on Antennas and Propagation,* vol. 39, No. 9, Sep. 1991.

* cited by examiner

*Primary Examiner*—Tan Ho
(74) *Attorney, Agent, or Firm*—Allen, Dyer, Doppelt, Milbrath & Gilchrist, P.A.

(57) ABSTRACT

A composite antenna reflector architecture for improving beam-to-beam isolation in a multi-spot illuminated reflector antenna employs a plurality of annular rings surrounding a central reflective dish and having respectively different controlled reflectivity profiles. The reflectivity-tailored reflector rings alter illumination taper and reduce selected sidelobe energy, and minimize degradation in coverage performance and gain slope in the radiation profile of the antenna. A respective ring employs a frequency selective surface laminate of layers containing different elements that resonate at different frequencies spectrally spaced to provide at least one composite frequency response characteristic.

23 Claims, 6 Drawing Sheets

REFLECTOR ANTENNA HAVING VARYING REFLECTIVITY SURFACE THAT PROVIDES SELECTIVE SIDELOBE REDUCTION

CROSS-REFERENCE TO RELATED APPLICATION

The present application is a continuation-in-part of U.S. patent application Ser. No. 09/666,008, filed Sep. 19, 2000 now U.S. Pat. No. 6,421,002, which is a continuation of Ser. No. 09/392,134 filed Sep. 8, 1999 U.S. Pat. No. 6,140,978, issued Oct. 31, 2000, entitled "Dual Band Hybrid Solid/Dichroic Antenna Reflector" (hereinafter referred to as the '978 patent), assigned to the assignee of the present application and the disclosure of which is incorporated herein.

FIELD OF THE INVENTION

The present invention relates in general to RF communication systems, and is particularly directed to a composite antenna reflector architecture containing an interior solid reflector region, which is adjacent at its perimeter to a generally ring-shaped or annular reflector. The interior solid region is effectively totally reflective to incident RF energy, while the annular reflector is formed of a plurality of regions containing frequency selective surfaces having respectively different partial reflectivities, that are effective to reduce selected sidelobe energy in the overall radiation profile of the antenna. A frequency selective surface is configured of a laminate of layers containing different elements that resonate at different frequencies, spectrally spaced so as to provide at least one composite frequency response characteristic.

BACKGROUND OF THE INVENTION

As described in the above-referenced '978 patent, in order to provide simultaneous RF illumination coverage of multiple adjacent terrestrial regions or 'spots', such as the (forty-four) oval regions of the beam pattern coverage map of the United States of FIG. 1, a geostationary satellite based antenna system typically contains a limited number of 're-used' antenna subsystems, operating at different sub-band spectral segments of an available RF bandwidth, and illuminating multiple spatially separated terrestrial regions.

Namely, illumination of all of the spots of the overall terrestrial coverage area is achieved by having the radiation pattern of each antenna subsystem individually pointable to multiple ones of a prescribed subset of spaced apart (not immediately adjacent) terrestrial regions. Thus, for example, illuminating the forty-four spot terrestrial coverage area of FIG. 1 with a four antenna-subsystem—such as that shown in FIG. 2 as being comprised of four antenna transmit-receive pairs A, B, C, D, or eight individual antenna reflectors (and attendant feed horn subsystems)—results in an antenna re-use factor of eleven.

Although the re-use factor may be decreased by reducing the number of (and thereby increasing the area of each of the) illuminated regions, doing so undesirably entails the deployment of larger and increased complexity hardware and/or an increased power specification. Moreover, even though such a multi-antenna system achieves a first level of (spatial) beam-to-beam isolation by illuminating immediately adjacent spots at mutually different sub-bands, there still remains the problem of sidelobe energy spillover of beams illuminating spatially separated regions having the same sub-band. While sidelobe performance and thus associated beam-to-beam isolation may be somewhat improved by tailoring (tapering) the feed horn pattern illuminating the reflector, physical and cost constraints placed on the feed horn structure at relatively high frequencies (e.g., Ku-band and above) effectively limit this approach.

SUMMARY OF THE INVENTION

In accordance with the present invention, the above-described beam-to-beam isolation problem is successfully addressed by a composite antenna reflector architecture that is configured to reduce one or more selected sidelobe portions of the overall radiation profile of the antenna spilling over into other regions illuminated regions in the same band. For this purpose, the antenna reflector of the invention contains a generally circular or polygonal, interior solid parabolic or alternately shaped reflector sector or region, that is adjacent at its perimeter to a generally ring-shaped or annular reflector sector. The interior solid region is effectively totally reflective to incident RF energy, while the annular reflector is formed of a plurality of rings having respectively different partial reflectivities, that alter the illumination taper and thereby reduce selected sidelobe energy, and minimizing degradation in coverage performance and gain slope in the overall radiation profile of the antenna.

The reflectivity profile across the rings may be varied in a number of alternative ways to produce a desired varying reflectivity profile. For example, the reflection coefficient of a respective ring may be fixed across the radius or width of the ring, or the reflection coefficient may be varied between a value of 1 (totally reflective) and 0 (totally transmissive) as a function of the radius from the center of the antenna reflector. Also, the values of the respective reflection coefficients for respective rings decrease in the radial direction outwardly from the central dish, so as to realize a tapered reflection coefficient profile across the composite reflector.

The manner in which a tapered reflectivity may be imparted to a respective ring may be achieved in a number of ways. In a first implementation, the resistivity of each ring may be varied, such as by coating the rings with respective films of differing resistivities. However, changing resistivity to vary a respective ring's reflection coefficient is less than optimum and undesirable from a practical standpoint in a spaceborne environment, due to the thermal issues introduced by the heat absorption properties of a resistive film.

Pursuant to a preferred implementation, rather than vary its resistivity, the composite resonant frequency response characteristic of each annular ring is selectively defined, so as to be different from that of an adjacent ring. This tailoring of the resonant frequency responses may be accomplished by forming a (low loss) frequency selective surface (FSS) type laminate reflector structure, similar to the dichroic laminate structure described and illustrated in the '978 patent, and containing a pair of overlapping, spatially parallel partially reflective surface layers containing elements such as slotted tripoles, that resonate at respectively different frequencies.

The physical materials employed in and the internal structure of the dual resonant laminate structure may correspond to those employed in the dichroic composite structure containing two frequency selective surfaces described and illustrated in the '978 Patent. Also, the composite antenna structure of the present invention may be deployed and supported using a backing structure of the type disclosed in the '978 Patent.

The dual resonant laminate of the present invention differs from the dichroic composite structure of the '978 patent in that the respectively different resonant frequencies of the two element-containing layers are relatively close together, spectrally. This spectral offset produces a resultant transmission profile that has generally the same (substantially flat) reflectivity or transmission over a prescribed bandwidth. The composite RF transmission profile of this type of low loss resonant laminate can be increased or decreased by changing the resonant frequency elements of one or both of the loaded layers so as to change the their mutual spectral separation, and thereby achieve a prescribed level of RF reflection over a prescribed RF bandwidth from the composite layer structure.

Pursuant to a further embodiment, each of the respective upper and lower layer portions of the laminate structure may contain multiple sets of different slotted elements to provide a plurality of spectrally separated composite response characteristics within the same multiband frequency selective surface (FSS).

In accordance with a dual band embodiment of the invention, the surrounding annular sector may contain two adjacent sets of (two) partially reflective ring-shaped reflectors that surround the central dish and whose respective reflection coefficients have a first set of values for a first operational band, and a second set of values for a second operational band. As in the dual band architecture of the '978 patent, the inner radial dimension of the exterior annular ring-containing sector is defined so that the effective aperture or beamwidth of the antenna reflector is the same for each of the two spaced apart ('high' and 'low') bands at which the antenna is intended to operate. This again allows the composite reflector to be coupled with dual-band feeds capable of operating at both spaced apart frequency bands, and produce the same spot beam pattern for both frequency bands.

For low band operation, the two interiormost rings are totally reflective, so as to effectively increase the diameter of the totally reflective central dish portion of the antenna, while the outer two rings have respectively different fixed or constant reflection coefficients that reduce the sidelobes of the antenna. For high band operation, the two outermost rings are transmissive, so as to effectively decrease the effective diameter of the antenna, while the two interiormost rings have respectively different fixed or constant reflection coefficients for selective sidelobe reduction.

DETAILED DESCRIPTION

Figure 1:
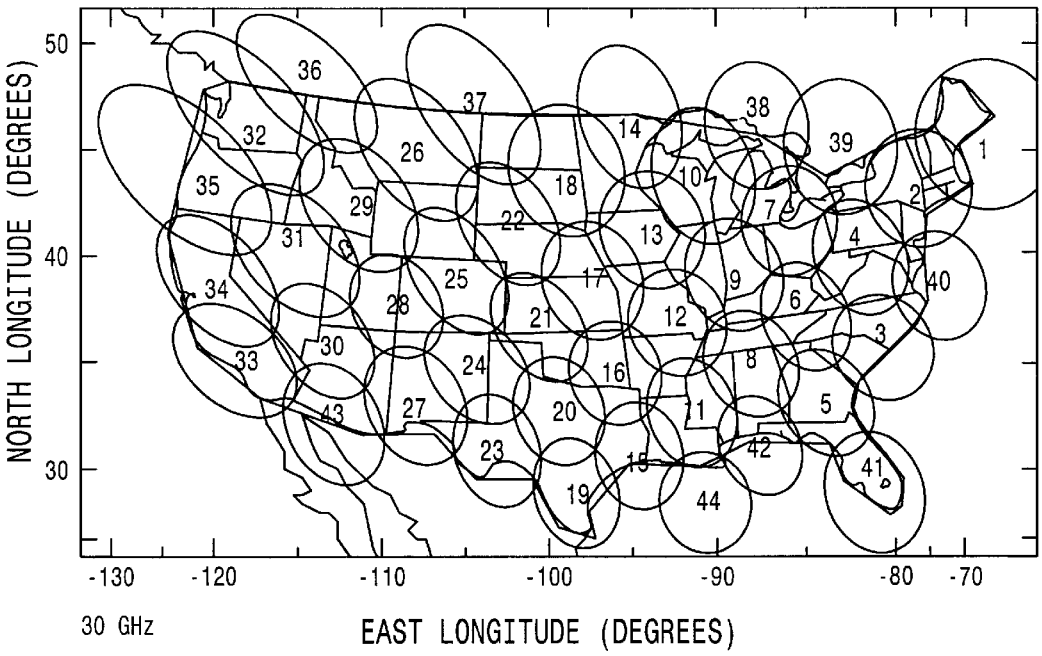
FIG. 1 is a beam pattern coverage map of the United States showing a plurality of spots associated with a terrestrial illumination pattern that may be provided by a geosynchronous satellite based antenna system.
Figure 2:
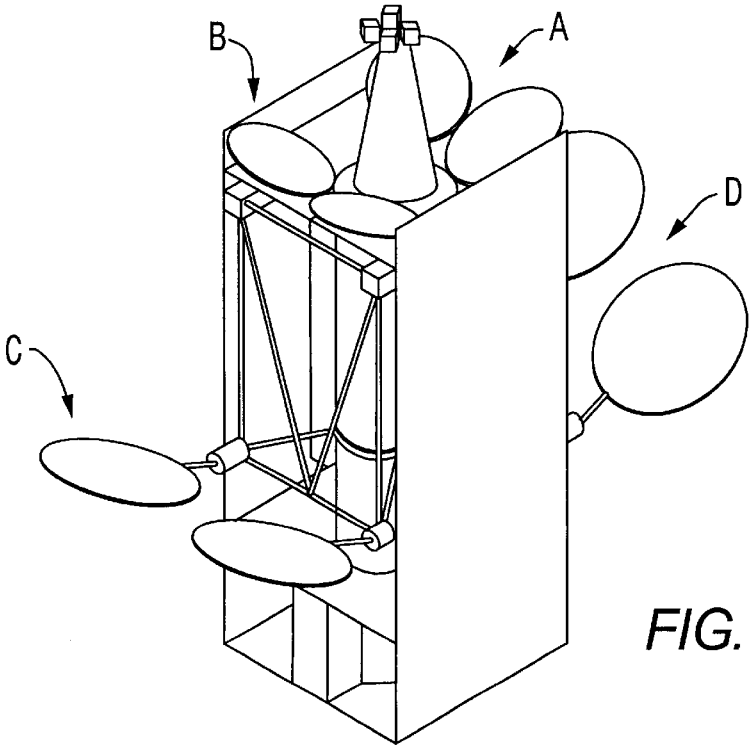
FIG. 2 diagrammatically illustrates an example of a satellite configuration which has four pairs of differently sized antenna reflectors and single band feed subsystems, operating at the respectively spaced apart frequency subbands for providing beam spot coverage of the plurality of oval regions in the beam pattern coverage map example of FIG. 1.
Figure 3:
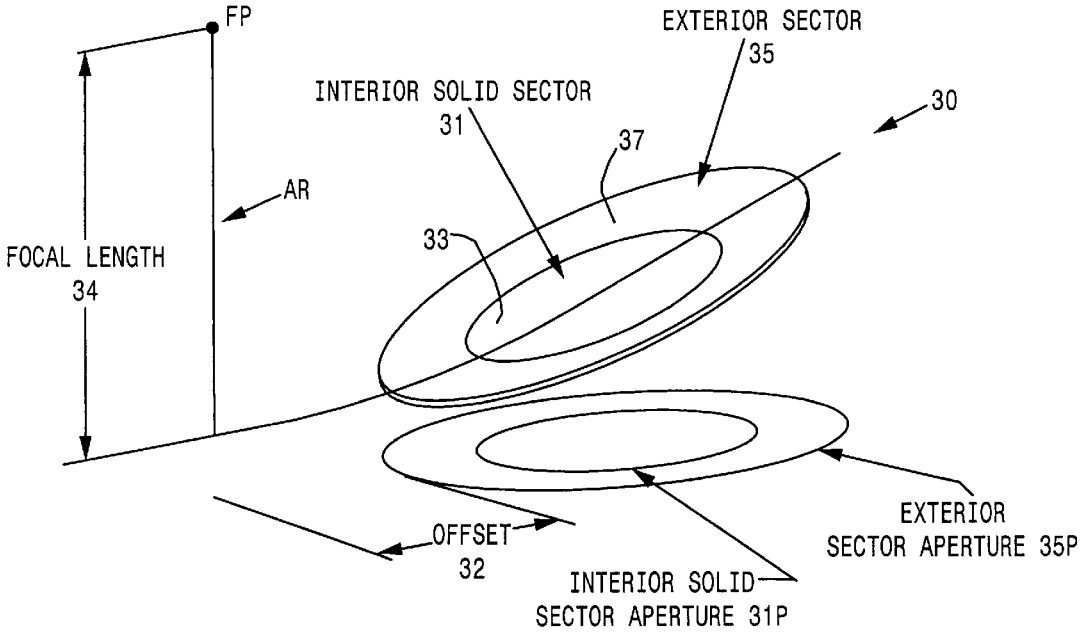
FIG. 3 is a diagrammatic perspective view of the overall configuration of the composite antenna reflector architecture of the present invention.

A diagrammatic perspective view of the overall configuration of the composite antenna reflector architecture of the present invention is illustrated in FIG. 3. As in the hybrid reflector architecture of the above-referenced '978 Patent, the composite reflector structure of the invention shown at 30 comprises a first, generally circular or polygonal, interior or central solid reflector sector region, or dish, 31, having an effectively totally reflective surface 33. This central dish 31 is shaped to provide a desired reflected RF energy distribution, such as, but not limited to a portion of a parabola of revolution, that is offset by a prescribed displacement 32 relative to an axis of revolution AR, and has a focal length 34.

The perimeter of the central dish 31 is adjoined with a generally ring-shaped or annular, generally circular or polygonal, exterior reflector sector 35, having a surface 37 that forms a continuous effective RF reflective surface with the (parabolic or otherwise shaped) surface 33 of the central dish. To minimize thermal distortion, each of the sectors 31 and 35 may be formed of a plurality of adjacent segments or panels, separations among which are defined to accommodate deflections due to thermal expansion. FIG. 3 also shows respective apertures 31P and 35P of the interior solid sector 31 and the exterior sector 35, as projected onto a planar surface normal to the focal axis AR.

As pointed out above, the reflective surface 33 of the central dish 31 is effectively continuous or solid, so that it totally reflects RF energy over a given frequency band. However, the surrounding annular sector 35 contains a plurality of partially reflective rings or annular regions having respectively different partial reflectivities, that effectively alter the illumination taper and thereby reduce selected sidelobe energy, in the radiation profile of the antenna.

Figure 5:
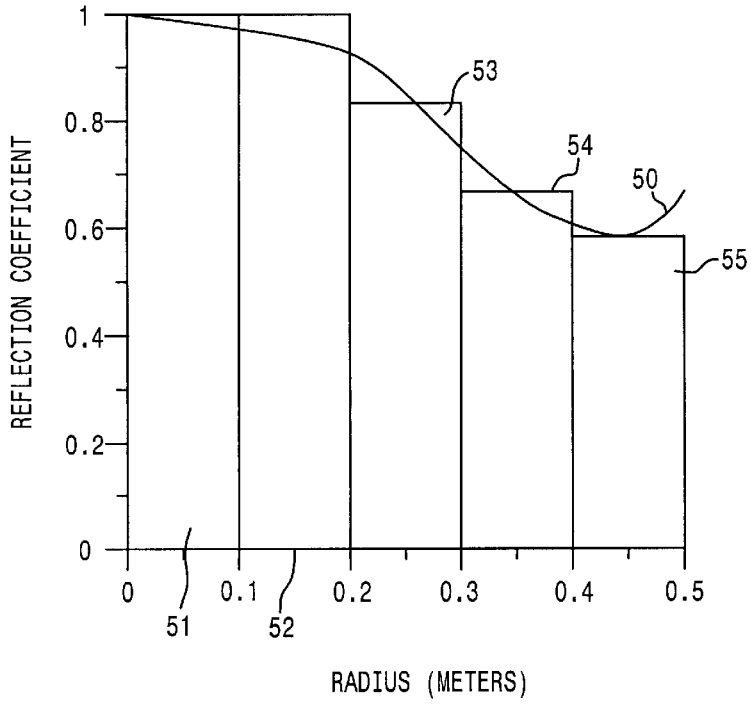
FIG. 5 shows the manner in which the required reflection coefficient profile of FIG. 4 may be discretely approximated by a profile produced by a plurality of successively contiguous annular reflector rings having respectively different reflectivity coefficients.
Figure 4:
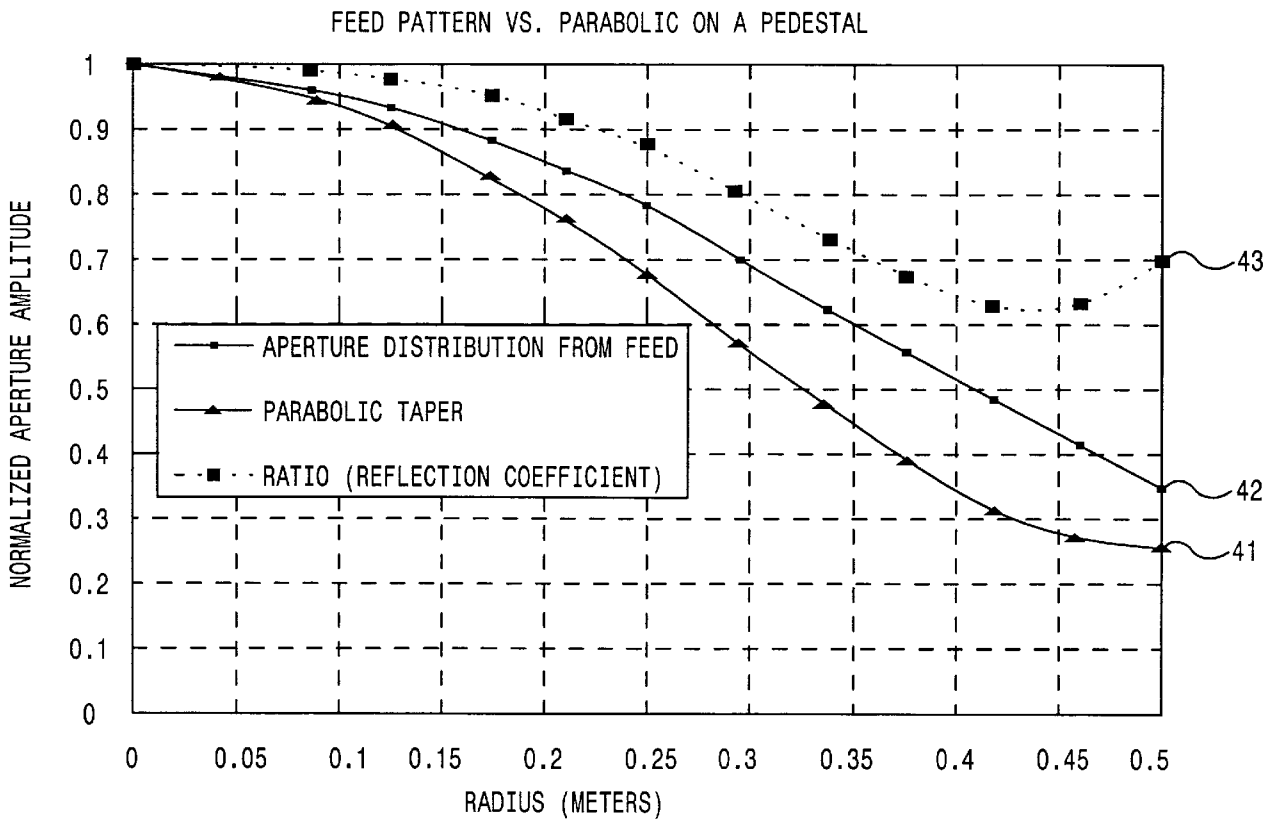
FIG. 4 shows the relationship between normalized aperture amplitude and radius of a reflectivity profile necessary to reduce sidelobes of the radiation pattern.

In accordance with a first, single band embodiment, the reflectivity characteristic of the surrounding annular sector is selectively tapered so as to effectively reduce selected sidelobe energy in the radiation profile of the antenna. FIG. 4 shows the relationship between normalized aperture amplitude and radius of a reflection profile necessary to reduce sidelobes of the radiation pattern. Curve 41 shows a parabolic taper profile, curve 42 shows the aperture distribution from the attendant feed, and curve 43 shows the profile of the required ratio of the main reflector's reflection coefficient. FIG. 5 shows the manner in which the required reflection coefficient profile 43 of FIG. 4 may be discretely approximated by a profile 50 that is produced by a plurality of successively contiguous annular rings (five in the illustrated example, at 51, 52, 53, 54 and 55) having respectively different reflectivities.

Figure 6:
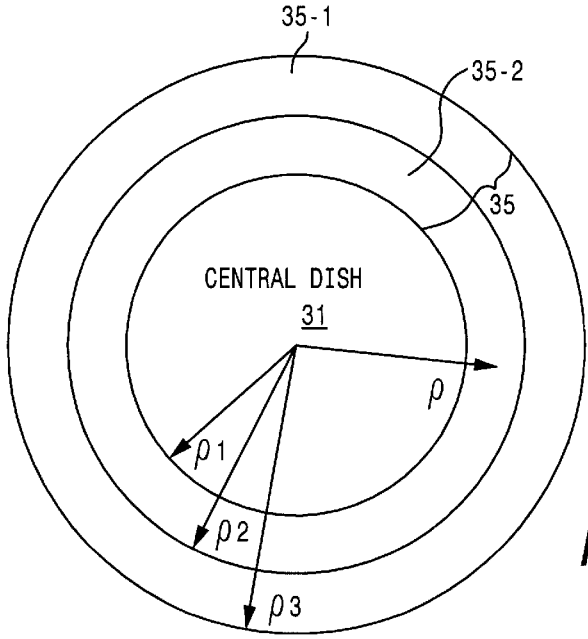
FIG. 6 shows a single band embodiment of the composite antenna reflector architecture of the present invention.

In accordance with a first, single band embodiment, shown in FIG. 6, the surrounding annular sector 35 contains a plurality (e.g., two in the illustrated embodiment) of partially reflective rings or annular regions 35-1 and 35-2 having respectively different partial reflectivities, that effectively alter the illumination taper and thereby reduce selected sidelobe energy in the radiation profile of the antenna for the band of interest.

In the architecture of FIG. 6, the reflectivity profile across the rings may be varied in a number of alternative ways to produce a desired varying reflectivity profile. For example, the reflection coefficient $\Gamma$ of a respective ring may be fixed across the radius $\rho$ of the ring, or the reflection coefficient $\Gamma$ may be varied between 1 and 0 as a function $f(\rho)$ of the radius $\rho$ from the center of the antenna reflector, where $\Gamma=1$ for total reflection, and $\Gamma=0$ for no reflection. In addition, the values of the respective reflection coefficients $\Gamma$ for respective rings decrease as one proceeds in the radial direction outwardly from the central dish (where $\Gamma=1$), so as to result in a tapered reflection coefficient profile across the composite reflector.

The manner in which a reduced reflectivity may be imparted to a respective ring may be achieved in a number of ways. Pursuant to a first scheme, the resistivity of each ring may be varied. To provide this variation the rings may be coated with respective films of differing resistivities. The use of a resistive film to modify the surface reflection coefficient and reduce sidelobes is described in an article by D. Jenn et al, entitled: "Low-Sidelobe Reflector Synthesis and Design Using Resistive Surfaces," IEEE Transactions On Antenna and Propagation, Vol. 39, No. 9, September 1991, pp 1372–1375. In the technique described in the Jenn article, the resistive film is applied to the reflector surface in an effectively ubiquitous manner, so as to produce a general reduction in the radiation profile, rather than a reduction of selected sidelobes of the radiation pattern—as is obtained by the present invention which uses multiple rings having respectively different reflection coefficients, as described above. The Jenn et article is simply cited to show a physical material (a resistive film) that may be used to produce a variation in resistivity and thereby a variation in the reflection coefficient of a respective ring.

While a variation in resistivity is one way to vary a respective ring's reflection coefficient, it is less than optimum and undesirable from a practical standpoint in a spaceborne environment, due to the thermal issues introduced by the heat absorption properties of a resistive film. Pursuant to a further and preferred implementation of the invention, rather than vary its resistivity, the resonant frequency response characteristic of each annular ring is selectively defined, so as to be different from that of an adjacent ring. This tailoring of the resonant frequency response may be accomplished by forming a (low loss) frequency selective surface (FSS) type laminate reflector structure, similar to the dichroic laminate structure described and illustrated in the '978 patent, and containing a pair of overlapping, spatially parallel partially reflective surface layers containing elements such as slotted tripoles, that resonate at respectively different frequencies.

Figure 7:
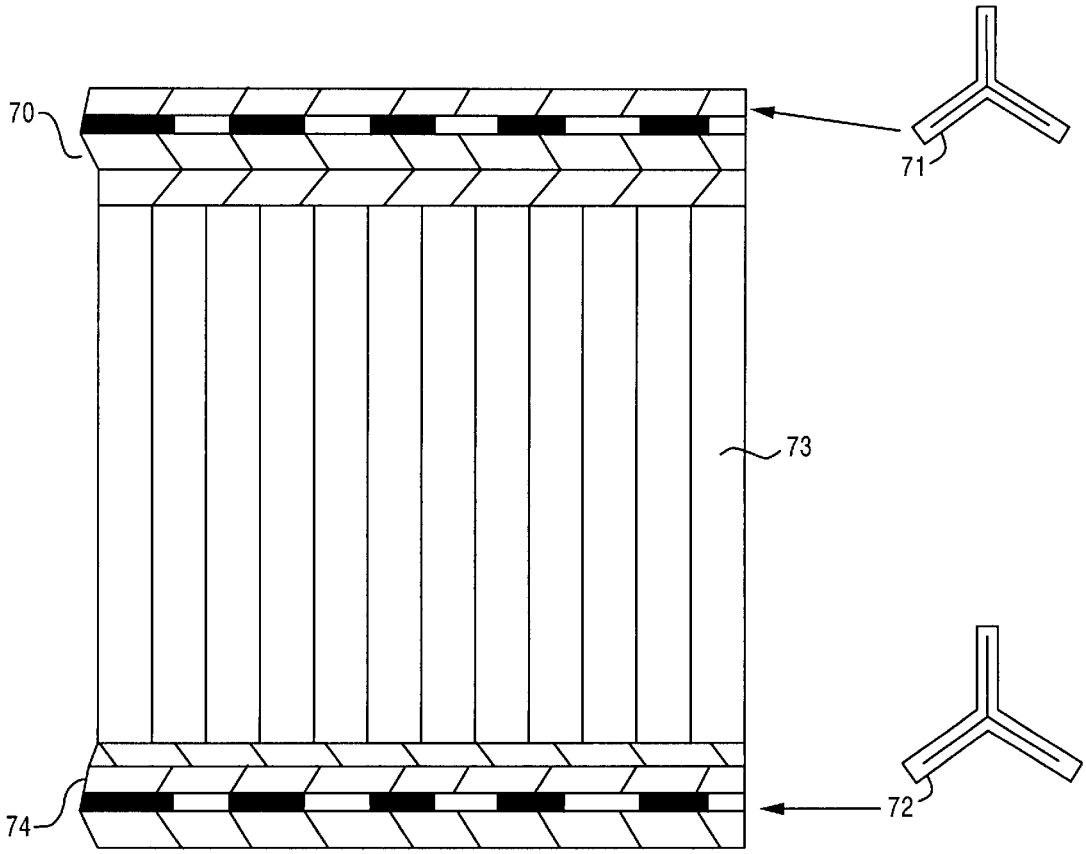
FIG. 7 is a cross-sectional diagram of a low loss reflector laminate structure.

A cross-sectional diagram of such a low loss reflector laminate structure is shown in FIG. 7 as having an upper layer 70, that contains a first plurality of slotted elements 71 of a first size and distribution, shown as tripole-configured slotted elements as a non-limiting example, separated by a supporting core 73 from a second plurality of slotted elements 72 formed in a lower layer 74, slotted elements 72 also being configured as slotted tripole elements 72 of a second size and distribution, as a non-limiting example.

In the laminate structure example of FIG. 7, the physical materials employed in, and the internal structure of the dual resonant laminate structure, may correspond to those employed in the dichroic composite structure containing two frequency selective surfaces described and illustrated in FIG. 12 in the '978 Patent. However, the dual resonant laminate structure employed in the present invention differs from the dichroic composite structure of the '978 patent. In the architecture of the above-referenced '978 patent, the frequencies in the different layers are the same. In the present invention, on the other hand, shown in FIG. 8, the respective resonant frequencies 81 and 82 of the slotted elements 71 and 72 in the respective two layers 70 and 74 are slightly offset from one another.

Figure 8:
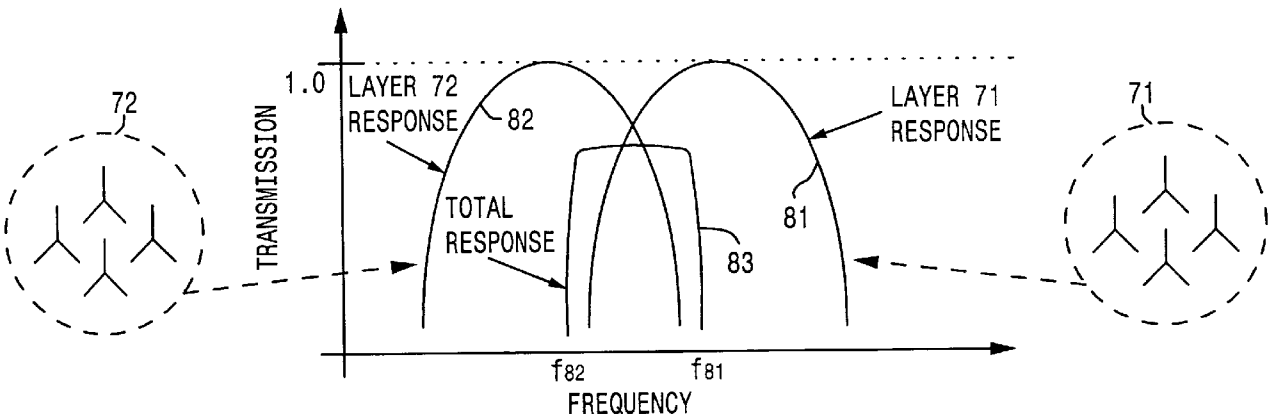
FIG. 8 is a composite transmission characteristic of for a laminate structure formed of different resonant frequency layers.

This slight spectral offset between the respective resonant responses 81 and 82 of the two (slotted) layers 70 and 74 of the dual band laminate structure of FIG. 7 produces a resultant transmission profile 83. As shown in FIG. 8, this resultant profile has generally the same (substantially flat) reflectivity or transmission over a prescribed bandwidth, lying between frequencies $f_{81}$ and $f_{82}$.

The (generally constant) composite transmission profile of this type of low loss resonant laminate can be increased or decreased by changing the resonant frequency of the elements of one or both of the layers, so as to modify their mutual spectral separations, and thereby achieve a prescribed level of RF reflection from (or complementarily transmission through) the composite layer structure.

Figure 10:
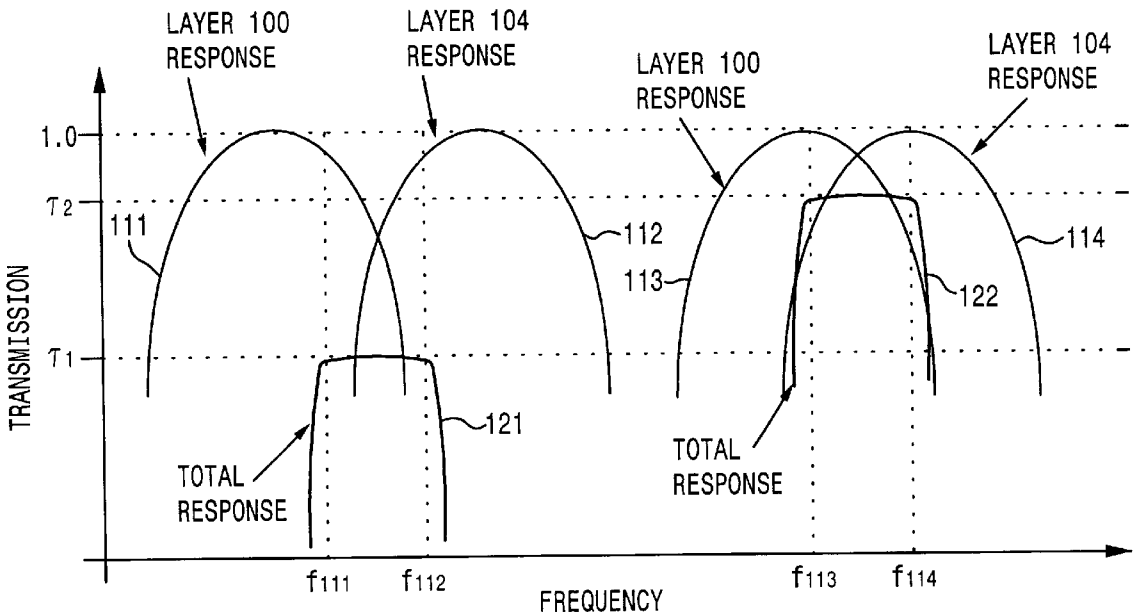
FIG. 10 shows the composite spectral response characteristic for the multiband frequency selective surface embodiment of FIG. 9.
Figure 9:
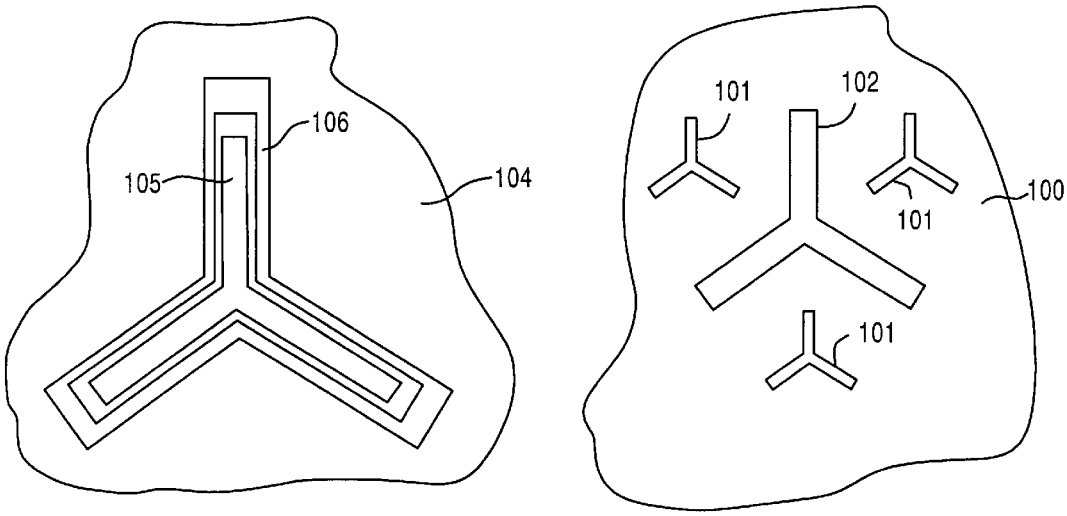
FIG. 9 is a diagrammatic plan view of upper and lower layer portions of a laminate structure containing multiple pairs of different sized slotted elements to realize a multiband frequency selective surface.

FIG. 9 is a diagrammatic plan view of a non-limiting example of the configurations of respective upper and lower layer portions of a laminate structure of the type shown in FIG. 7, described above, that contain different sets (here pairs) of slotted elements to provide a plurality (two in the illustrated example) of spectrally separated controlled response characteristics, that realize a multiband frequency selective surface (FSS), the overall (here dual band) response characteristic for which is shown in FIG. 10.

In the embodiment of FIGS. 9 and 10, rather than contain a first plurality of only a single type of slotted elements, the upper layer 100 of the laminate structure contains a first distribution of respectively different slotted elements, such distributions of differently sized tripoles shown at 101 and 102. Associated with the first distribution of slotted elements 101, 102 in the upper layer 100, the lower layer 104 contains a second distribution of respectively different slotted elements, such distributions of differently sized tripoles 105 and 106. (It may be noted that the same architecture would not contain both of these different approaches. The elements in layer 100 and 104 would both correspond to either elements 105/106 or elements 101/102. The difference between the two layers is the fact that they are scaled to produce slightly different resonant frequencies.)

Like the laminate structure of FIG. 7, the respectively different resonant frequencies associated with the respective slotted elements 101 and 105 in the respective upper and lower layers 100 and 104 are relatively close together, as shown at 111 and 112 in FIG. 10. Likewise, the respectively different resonant frequencies associated with the respective slotted elements 102 and 106 in the respective upper and lower layers 100 and 104 are relatively close together, as shown at 113 and 114 in FIG. 10.

As shown in FIG. 10, this slight spectral offset between the respective sets (here pairs) of resonant responses 111, 112 and 113, 114 of the two layers 100 and 104 of the multi-band laminate structure of FIG. 9 produces a plurality (here a pair) of resultant spaced apart composite or transmission profiles 121, 122 (rather than a single resultant profile shown at 83 in FIG. 8).

As in the single resultant profile of FIG. 8, the resultant profiles 121 and 122 have generally flat reflectivity or transmission characteristics $\tau_1$ and $\tau_2$ over respectively different bandwidths. Profile 121 lying between frequencies $f_{111}$ and $f_{112}$, and profile 122 lying between frequencies $f_{113}$ and $f_{114}$. As in the embodiment of FIG. 7, these generally constant composite transmission profiles can be tailored (increased or decreased) by changing the resonant frequency elements of the various sets of slotted elements in one or both of the layers, so as to change the their mutual spectral separations, and thereby achieve desired levels of RF reflection from (or complementarily transmission through) the composite layer structure.

Figure 11:
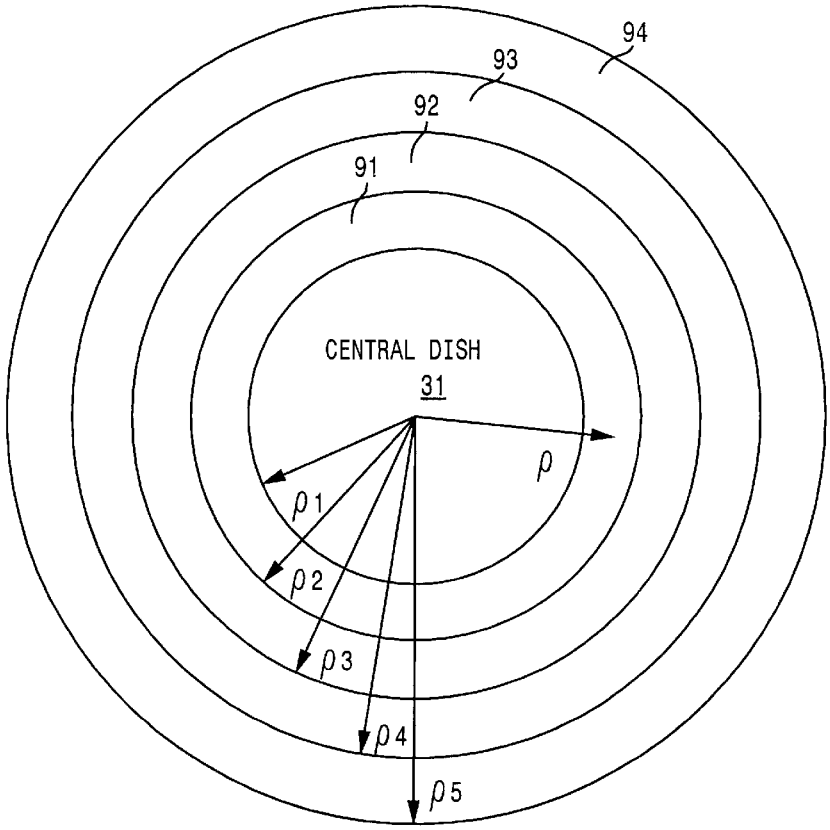
FIG. 11 shows a further dual band embodiment of the composite antenna reflector architecture invention.

FIG. 11 shows a further dual band embodiment of the invention, in which the surrounding annular sector 35 contains a plurality of partially reflective rings 91, 92, 93, 94, that surround the central dish 90, and whose respective reflection coefficients $\Gamma_1$, $\Gamma_2$, $\Gamma_3$, $\Gamma_4$ have a first set of values for a first operational band, and a second set of values for a second operational band.

As in the dual band architecture of the '978 patent, the inner radial dimension of the exterior annular ring-containing sector is defined so that the effective aperture or beamwidth of the antenna reflector is the same for each of the two spaced apart ('high' and 'low') bands at which the antenna is intended to operate. This again allows the composite reflector to be coupled with dual-band feeds capable of operating at both spaced apart frequency bands, and produce the same spot beam pattern for both frequency bands. As described in the '978 Patent, this reduces by a factor of two the number of antenna reflectors and associated hardware that would otherwise have to be mounted on a (geostationary) satellite to obtain simultaneous coverage of a single terrestrial region or a plurality of terrestrial regions.

For purposes of the present discussion, the first set of reflection coefficients will be termed 'high' band coefficients, while the second set of reflection coefficients will be termed 'low' band coefficients. In particular, with $\rho=1$ for total reflection, and 0 for no reflection, as described above with reference to FIG. 6, the low band coefficient values may be defined as follows:

$\Gamma_4$=a constant, for $\rho$ equal to or greater than $\rho_4$ and less than or equal to $\rho_5$, and $\Gamma_2$ greater than or equal to 0 and less than $\Gamma_1$;

$\Gamma_3$=a constant, for $\rho$ equal to or greater than $\rho_3$ and less than or equal to $\rho_4$, and $\Gamma_1$ greater than $\Gamma_2$ and greater than $\Gamma_0$;

$\Gamma_2$=a prescribed value, such as 1, for $\rho$ equal to or greater than $\rho_2$ and less than or equal to $\rho_3$;

$\Gamma_1$=a prescribed value, such as 1, for $\rho$ equal to or greater than $\rho_1$ and less than or equal to $\rho_2$; and $\Gamma_0$=1, for $\rho$ equal to or greater than 0 and less than or equal to $\rho_1$.

From the above set of coefficient relationships it can be seen that, for low band (relatively longer wavelength) operation, the two interiormost rings 91 and 92 are substantially reflective, so as to effectively increase the diameter of the totally reflective central dish portion of the antenna, while the outer two rings 92 and 93 have respectively different fixed or constant reflection coefficients that reduce the sidelobes of the antenna.

The high band coefficient values may be defined as follows (again with $\rho=1$ for total reflection, and 0 for no reflection):

$\Gamma_4$=a prescribed value, such as 0, for $\rho$ equal to or greater than $\rho_4$ and less than or equal to $\rho_5$;

$\Gamma_3$=a prescribed value, such as 0, for $\rho$ equal to or greater than $\rho_3$ and less than or equal to $\rho_4$;

$\Gamma_2$=constant, for $\rho$ equal to or greater than $\rho_2$ and less than or equal to $\rho_3$, and $\Gamma_2$ greater than or equal to 0 and less than $\Gamma_1$;

$\Gamma_1$=constant, for $\rho$ equal to or greater than $\rho_1$ and less than or equal to $\rho_2$, and $\Gamma_1$ greater than or equal to $\Gamma_1$ and less than $\Gamma_0$; and $\Gamma_0$=1, for $\rho$ equal to or greater than 0 than or equal to $\rho_1$.

$\Gamma_0$=1, for $\rho$ equal to or greater than 0 and less than or equal to $\rho_1$.

Namely, for high band (relatively shorter wavelength) operation, the two outermost rings 93 and 94 are substantially transmissive, so as to effectively decrease the effective diameter of the antenna, while the two interiormost rings 91 and 92 have respectively different fixed or constant reflection coefficients for selective sidelobe reduction.

The composite antenna structure of the present invention may be deployed and supported using a backing structure of the type described and illustrated in the '978 Patent. Briefly, the backing support structure may comprise a generally regular polygon-shaped (e.g., hexagonal) frame formed of interconnected struts made of a material whose coefficient of thermal expansion (CTE) is relatively low and compatible with that of the antenna proper.

The reflector may be attached to the (backing frame) support structure using elements such as flexures, clips, pins and the like, which minimize the thermal distortions resulting from mismatch between the CTE of the reflector and support structure. The backing frame is preferably sized to be attached to and provide stable structural support for the interior solid sector and the exterior annular rings of the antenna reflector. The backing frame may be integrally joined with the satellite via an actuator coupling joint, which, when combined with an actuator mechanism system, enables deployment and/or proper pointing of the reflector system. As in the '978 Patent the backing frame may be configured to deflect, absorb, or transmit, or otherwise minimize reflection of RF energy that has passed through the outer rings, and thereby electrically decouple the backing structure from the intended RF reflector functionality of the antenna.

As will be appreciated from the foregoing description, the above-described beam-to-beam isolation problem of a multi-spot illuminated reflector antenna, having a prescribed re-use factor, is successfully addressed by the composite antenna reflector architecture of the present invention, which employs a plurality of annular rings surrounding a central reflective dish and having respectively different frequency selective surfaces that provide controlled reflectivity profiles. These individually reflectivity-tailored reflector rings serve to alter the illumination taper and thereby reduce selected sidelobe energy, while minimizing degradation in coverage performance and gain slope in the overall radiation profile of the antenna.

While we have shown and described several embodiments in accordance with the present invention, it is to be understood that the same is not limited thereto but is susceptible to numerous changes and modifications as known to a person skilled in the art, and we therefore do not wish to be limited to the details shown and described herein but intend to cover all such changes and modifications as are obvious to one of ordinary skill in the art.

What is claimed:

1. An antenna reflector architecture comprising:

a first reflector having a first geometry and being effectively reflective to RF energy at a first frequency band;

a second reflector adjoining said first reflector to form therewith a composite reflector having a second geometry different from said first geometry that defines therewith a prescribed radiation profile for said antenna at said first frequency band; and wherein said second reflector has plural regions of respectively different reflectivities at said first frequency band which are effective to reduce at least one selected sidelobe of said prescribed radiation profile of said antenna.

2. The antenna reflector architecture according to claim 1, wherein said first reflector has a generally circular or polygonal geometry that forms an interior solid reflector component of said composite reflector, and said second reflector has a generally ring-shaped circular or polygonal geometry that forms an exterior reflector component that surrounds and is adjacent to the perimeter of said first reflector.

3. The antenna reflector architecture according to claim 1, further including a support structure for said first and second reflectors, and being configured to reduce reflections towards the coverage area from RF energy passing through said second reflector.

4. The antenna reflector architecture according to claim 3, wherein said support structure is covered with material that absorbs RF energy at said second frequency band.

5. The antenna reflector architecture according to claim 3, wherein said support structure is configured to deflect RF energy in said second frequency band away from the coverage area of said composite reflector.

6. The antenna reflector architecture according to claim 3, wherein said support structure has a reduced reflective cross section in the direction of incidence of RF energy in said second frequency band.

7. The antenna reflector architecture according to claim 3, wherein said support structure is comprised of materials which do not reflect significant RF energy in said second frequency band.

8. The antenna reflector architecture according to claim 1, wherein said second reflector comprises multiple adjoining concentric annular rings of respectively different reflectivities at said first frequency band which are effective to reduce a first sidelobe of said prescribed radiation profile of said antenna.

9. The antenna reflector architecture according to claim 1, wherein a respective annular ring of said second reflector comprises plural overlapping annular ring layers containing respectively different resonant elements that are resonant at respectively different resonant frequencies and provide a composite reflectivity characteristic in accordance with a prescribed relationship between said respectively different resonant frequencies.

10. The antenna reflector architecture according to claim 1, wherein a respective annular ring of said second reflector comprises first and second overlapping annular ring layers, respectively containing first and second resonant elements that are resonant at first and second resonant frequencies and provide said respective annular ring with a composite reflectivity characteristic that is generally flat over a prescribed bandwidth between said first and second resonant frequencies.

11. The antenna reflector architecture according to claim 1, wherein said second reflector comprises dichroic rings, each of which contains multiple ring regions of respectively different reflectivities at first and second frequency bands which are effective to reduce at least one selected sidelobe of said prescribed radiation profile of said antenna at each of said first and second frequency bands.

12. The composite antenna reflector architecture having a radiation profile and being configured to reduce one or more selected sidelobe portions of said radiation profile, said architecture comprising a generally circular or polygonal, interior solid shaped reflector sector adjacent at its perimeter to a generally annular reflector sector, said interior solid region being effectively totally reflective to incident RF energy, while said annular reflector sector contains a plurality of rings having respectively different partial reflectivities, that alter illumination taper and reduce selected sidelobe energy in the overall radiation profile of the antenna.

13. The composite antenna reflector architecture according to claim 12, wherein a respective one of said rings has a generally constant reflection coefficient across the radius of the ring.

14. The composite antenna reflector architecture according to claim 12, wherein a respective one of said rings has a reflection coefficient that varies across the radius of the ring.

15. The composite antenna reflector architecture according to claim 14, wherein a respective one of said rings has a reflection coefficient that varies across the radius of the ring as function radial distance from the center of said solid reflector.

16. The composite antenna reflector architecture according to claim 12, wherein values of respective reflection coefficients for respective rings of said annular sector decrease in an outward radial direction so as to realize a tapered reflection coefficient profile across said composite antenna reflector architecture.

17. The composite antenna ref lector architecture according to claim 12, wherein respective ones of said plurality of rings have respectively different resistivities.

18. The composite antenna reflector architecture according to claim 12, wherein a respective ring of said annular reflector sector comprises plural overlapping annular ring layers containing respectively different resonant elements that are resonant at respectively different resonant frequencies and provide a composite reflectivity characteristic in accordance with a prescribed relationship between said respectively different resonant frequencies.

19. The composite antenna reflector architecture according to claim 12, wherein a respective ring of said annular reflector sector comprises first and second overlapping annular ring layers, respectively containing first and second resonant elements that are resonant at first and second resonant frequencies and provide said respective annular ring with a composite reflectivity characteristic that is generally flat over a prescribed bandwidth between said first and second resonant frequencies.

20. The composite antenna reflector architecture according to claim 12, wherein said annular reflector sector comprises dichroic rings, each of which contains multiple ring regions of respectively different reflectivities at first and second frequency bands which are effective to reduce at least one selected sidelobe of said radiation profile at each of said first and second frequency bands.

21. A frequency selective structure comprising a laminate of layers containing respectively different slotted resonant elements that are resonant at respectively different resonant frequencies spectrally spaced so as to provide at least one composite frequency response characteristic that is generally flat over a prescribed bandwidth.

22. The frequency selective structure according to claim 21, wherein respective layers of said laminate contain multiple sets of different slotted elements, having respective composite reflectivity frequency response characteristics that combine to provide a plurality of spectrally separated composite frequency response characteristics that are each generally flat over a prescribed bandwidth.

23. The frequency selective structure according to claim 22, wherein said respective layers of said laminate comprise mutually overlapping layers, containing first and second sets of resonant elements that are resonant at first and second resonant frequencies and provide a first composite reflectivity characteristic that is generally flat over a first prescribed bandwidth between said first and second resonant frequencies, and third and fourth sets of resonant elements that are resonant at third and fourth resonant frequencies and provide a second composite reflectivity characteristic that is generally flat over a second prescribed bandwidth between said third and fourth resonant frequencies, spectrally separated from said first and second resonant frequencies.

* * * * *

UNITED STATES PATENT AND TRADEMARK OFFICE

CERTIFICATE OF CORRECTION

PATENT NO. : 6,563,472 B1 
DATED : May 13, 2003
INVENTOR(S) : Timothy Durham et al.

It is certified that error appears in the above-identified patent and that said Letters Patent is hereby corrected as shown below:

Column 1,
Line 9, delete “6,421,002” insert -- 6,421,022 --

Column 2,
Lines 62 and 65, delete “Patent” insert -- patent --

Column 3,
Line 9, delete “the their” insert -- the --

Column 4,
Line 7, delete “of for” insert -- for --
Line 9, delete “:” insert -- ; --
Line 26, delete “Patent” insert -- patent --

Column 5,
Line 44, delete “et” insert -- et al --

Column 6,
Line 13, delete “Patent” insert -- patent --

Column 7,
Line 40, delete “Patent” insert -- patent --

Column 8,
Line 19, delete “0 than or equal to $\rho_1$.” insert -- 0 or equal to $\rho_1$; --
Lines 30 and 47, delete “Patent” insert -- patent --

UNITED STATES PATENT AND TRADEMARK OFFICE

CERTIFICATE OF CORRECTION

PATENT NO. : 6,563,472 B1 
DATED : May 13, 2003
INVENTOR(S) : Timothy Durham et al.

It is certified that error appears in the above-identified patent and that said Letters Patent is hereby corrected as shown below:

Column 10,
Line 41, delete “ref lector” insert -- reflector --

Signed and Sealed this

Twelfth Day of August, 2003

JAMES E. ROGAN
*Director of the United States Patent and Trademark Office*